United States Patent [19]

Boswell et al.

[11] Patent Number: 4,915,729

[45] Date of Patent: Apr. 10, 1990

[54] METHOD OF MANUFACTURING METAL POWDERS

[75] Inventors: Peter Boswell, Acacias/Geneva; Dag F. Richter, Carouge; Georges Haour, Geneva, all of Switzerland

[73] Assignee: Battelle Memorial Institute, Geneva, Switzerland

[21] Appl. No.: 177,891

[22] Filed: Apr. 4, 1988

Related U.S. Application Data

[63] Continuation of Ser. No. 2,632, filed as PCT CH86/00046 on Apr. 11, 1986, published as WO86/06013 on Oct. 23, 1986, abandoned.

[30] Foreign Application Priority Data

Apr. 16, 1985 [CH] Switzerland ..... 1613/85

[51] Int. Cl.[4] ..... B22F 9/06

[52] U.S. Cl. ..... 75/331; 75/954; 75/356; 164/46

[58] Field of Search ..... 75/251-254, 75/0.5 R, 0.5 C; 264/6, 10, 12

[56] References Cited

U.S. PATENT DOCUMENTS

| | | | |
|---|---|---|---|
| 3,752,611 | 8/1973 | Reed et al. | 425/7 |
| 4,069,045 | 1/1978 | Lundgren | 75/0.5 C |
| 4,104,342 | 8/1978 | Wessel | 864/12 |
| 4,359,434 | 11/1982 | Tiberg | 264/7 |
| 4,377,375 | 3/1983 | Slaughter | 425/8 |
| 4,486,225 | 12/1984 | Osborn et al. | 75/0.5 R |

FOREIGN PATENT DOCUMENTS

| | | |
|---|---|---|
| 899748 | 12/1953 | Fed. Rep. of Germany . |
| 2046873 | 3/1971 | France . |
| 2150710 | 3/1973 | France . |
| 7900132 | 3/1979 | World Int. Prop. O. . |

*Primary Examiner*—L. Dewayne Rutledge
*Assistant Examiner*—David W. Schumaker
*Attorney, Agent, or Firm*—Cushman, Darby & Cushman

[57] ABSTRACT

A molten metal is placed in contact with a bed of moving beads. The molten metal breaks up into fine particles which are rapidly cooled in contact with the beads and consequently acquire a structure which is typical for such rapid cooling.

9 Claims, 3 Drawing Sheets

5 Figs

METHOD OF MANUFACTURING METAL POWDERS

This is a continuation of application Ser. No. 002,632, filed as PCT CH86/00046 on Apr. 11, 1986, published as WO86/06013 on Oct. 23, 1986, which was abandoned upon the filing hereof now abandoned.

The invention relates to a method of manufacturing metal powders. It also relates to a device for working the method, and variants of the device.

As known, great interest is at present being aroused by metal powders obtained by rapid cooling of the particles of a molten metal or alloy. During the almost instantaneous solidification (quenching) the metal retains or acquires a typical structure which depends on the rate of cooling. Structures of this kind include "amorphous" structures and "metal glasses" or "m.c." having physical properties which are often substantially different from those of the same metal after slower cooling. Frequently, "metal glass" has important magnetic, mechanical and chemical properties making it suitable for numerous applications in electricity, machine construction and chemical engineering.

Numerous metals and alloys can be broken up in this way, inter alia ferrous metals, steel, nickel, chromium, copper, aluminium and zinc. The powdered metals are then compacted by powder metallurgy methods and formed into various shapes for commercial use, inter alia ingots, bars, filaments, ribbons and the like, and into products moulded directly by sintering. There are already numerous existing processes for coverting metal and alloys into powder. For example document US-A-3,598,567 describes a method in which a jet of molten metal is atomised by a stream of air and the resulting droplets are rapidly cooled by a cooling fluid, inter alia a gas or low-temperature liquid, or a metal surface having high thermal conductivity, such as copper, silver, steel or lead. To obtain the desired effect (i.e. preservation of the amorphous or "m.c." structure of the molten metal), cooling speeds of the order of a hundred degrees C./sec, may be suitable in certain cases, but higher speeds of the order of $10^4$ to $10^{6°}$ C./sec may be advantageous in other cases.

Other similar processes are described in the following documents: US-A-3,325,277; 3,646,177; 3,764,295; 3,813,196 and 3,85,6513: M. H. Kim et al, Proc. 4th Int. Conf. on Rapidly Quenched Metals (Sendai 1981), pp. 85–88. Other methods can be used to break up a jet of molten metal by directing it against a rapidly-moving solid surface, e.g. a rotating disc or cylinder, whereupon the liquid metal is sheared and forms fine particles. A process of this kind is described in document US-A-2,555,131 and document US-A-4,386,896, where atomisation of molten metal is combined with spraying of atomised particles onto a rotating disc (see also G. Thursfield et al., J. Phys. E: Sci. Instrum. 4 (1971), pp. 675–676, A. R. E. SINGER et al., Powder Metallurgy 2, (1980) pp. 81–85; M. Lebo et al., Metallurgical Transactions, 5 (1974), pp, 1547–1554).

More recently, USA-4,355,057 has disclosed a method of manufacturing metal powders where the particles have a calibrated size. To this end, molten metal droplets are made to collide with solid metal particles by spraying a molten jet of atomised metal approximately horizontally on a steam of horizontally falling granular metal. In contact with a solid grain of metal, a molten metal droplet solidifies abruptly and adheres to the grain, increasing its size. The grains are then recycled in the process until, after successive contact with other droplets of liquid metal, they have acquired a given size and can then be collected in a sorting device.

In spite of their various advantages, the prior-art methods are not suitable for on the one hand rapidly cooling a molten metal while simultaneously dividing it into fine particles having sharp corners and/or on the other hand simultaneously crushing the particles, inter alia into flakes in the case where the molten metal is solididied by crushing drops of the metal against a cold surface, resulting in the formation of a solid metal film on the surface.

These results have now been achieved by the method according to the invention defined in claim 1. In a first embodiment, the molten metal is first divided into fine droplets, e.g. by spraying or pulverization by known methods, and the droplets are sprayed onto a moving bed of beads so that the droplets are crushed and cooled in contact with the beads and form a film on them which is then crushed into flakes by the mechanical effect exerted on the film by the bed of moving balls, which collide with each other. When the flakes have reached the desired size after a certain residence time in the moving bed, they can easily be collected. continuously or batchwise, by a sorting device (a grid, screen or the like).

Clearly, and this is one of the particularly advantageous features of the invention, the characteristics of these flakes can be controlled by modifying various operating parameters in the present process, such as the speed and type of motion of the beads, the nature and dimensions thereof, and the temperature and number of beads per unit operating volume. Other parameters such the nature and temperature of the molten metal or alloy, its flow rate and the size of the sprayed droplets, are also important with regard to the size, shape and thickness of the flakes obtained by the present process. For example, if the balls and molten metal drops are large, the films of solidifed metal obtained by crushing and abrupt cooling or the drops on the balls will be correspondingly greater in area. Similarly, if the balls collide abruptly, the atomisation of the films of solidified metal will be correspondingly more efficient and the flakes will be finer.

The flakes obtained by the present method can be used, after dispersion in a suitable binder, to obtain metallized coating compositions. Depending on their composition, the coatings can serve decorative purposes, or can be used to reflect certain electromagnetic wavelengths or as conductors of electricity (Faraday cages), inter alia in the electronic apparatus sector.

The binders can be resins known in the sector of pastes, paints, coatings, varnish and the like. These materials are well known to the skilled addressee, either in polymer form or as monomers polymerisable e.g. by heat or photochemically. The present compositions for metallised coatings can also comprise any additives or solvents generally used in this sector. Such materials are well known in the coating art and need not be further detailed.

In another embodiment of the method, the molten metal, after being divided into droplets if required, is directed against beads driven at a speed such that after the droplets strike them, they break up into particles which cool (practically simultaneously), acquiring, if desired, sharp corners. It is known that, during subsequent conversion by powder metallurgy methods, powders made up of metal particles having sharp angles have considerable advantages over powders made up of rounded particles. A search for novelty in this sector has yielded the following texts among others. US-A-4,508,666 (HOECHST); 4,435,342 (WENTZELL), 4,396,420 (DORNIER); 3,963,811 (TAMURA); 3,897,016 (LINDE); 3,624,796 (ENGLISH CLAYS); 2,380,253 (McCOY) 1,938,876 (TAKATA); an extract from "Xerox Disclosure Journal" dated May-June 1977; USA 4104342 & DE-A-2144220 (Mannesmann); US-A-3665,837 (RED et al); 4374633 (HART) and 3726621 (CICHY).

Documents US-A-4104342 and DE-A-2144220 relate to a method of manufacturing a metal powder by generally known means, in which a molten metal is atomised into particles and the particles are cooled by a bed of silica sand, the object of the bed being to prevent the particles from agglomerating. A bed of sand has a very remote similarity to the beads or balls according to the invention, which have a vitally important mechanical effect during the shaping of the particles of the present powder.

Document US-A-3655837 discloses atomising a molten metal into particles which are then agglomerated with solid particles of the same metal in order to produce irregularly-shaped particles. This citation does not contain any of the typical features of the method according to the invention with regard to the use of a bed of moving beads.

According to document US-A-4,374,633 a nozzle for spraying a molten metal is periodically scoured by an abrasive powder. This citation in no way suggests the method according to the invention.

Document US-A 3,726,621 relates to manufacture of refractory oxides having abrasive properties. In this method, a molten mineral mixture is added to a bed of metal balls. The bed, however, is not agitated so as to produce a dynamic effect (or impact) on contact of the liquid with the balls, and consequently this document does not disclose the specific effects or advantages of the invention. Consequently, the disclosure therein would not suggest to the skilled addressee to use a bed of rapidly moving balls for manufacturing metal powders in non-spherical grains as per the present invention.

The beads used in the present method can be made of a wide range of materials and have many varied shapes. Preferably the beads are made of materials which are hard and resistant to impact and abrasion (except of course for special cases where it is not desired that the material resulting from wear on the balls should not be mixed with the metal powder obtained. These materials may e.g. be metals and alloys or minerals, e.g. certain ceramics and cermets*. The metals may more particularly be steel, nickel, cobalt, copper, bronze, chromium, precious metals, etc. The minerals may e.g. be metal carbides, nitrides or borides (also as surface coatings on beads having a metal core), alumina, corundum, zircon, etc. All these bead materials must of course be good conductors of heat in order to ensure rapid cooling of the molten metal in contact with them. Depending on requirements, however, i.e. depending on the fineness of the powder obtained when the liquid metal is broken by the impact of these beads, it may be advantageous to limit the cooling rate and delay the hardening of the disintegrating particles by suitably using the heat absorption coefficient of the bead material. In general, the thermal conductivity of the bead material will be in the range of 1–50 cal° C. m/sec though values above or below this range may be suitable in certain special cases.

*N.B Metal ceramics

We can almost say that the beads can have any shape, except that if it is not a solid or revolution, their corners must be sufficiently rounded to prevent the beads from breaking during the impact to which they are subjected. Preferably, use is made of ovoid or spherical balls of very variable size, i.e. of the order of a fraction of a millimeter to about 15–20 mm in diameter. The bead diameter of course is related to the nature of the powder which it is desired to obtain. Large balls produce more violent but less frequent impacts than small balls. In general, it is advantageous to use balls about 0.5 to 10 mm in diameter, but these values can be exceeded in special cases. In the case of ellipsoidal balls, the ratio of the major to the minor diameter will preferably be between 1.2 and 4. Non-spherical balls, in the present method, have a possibly less regular, homogeneous effect than round balls when fragmenting and crushing the required metal powder, but the transfer of kinetic energy from the agitator to the bed of beads is more efficient in the case of ovoid balls than for spherical balls.

The types of agitation to which the bed of balls is subjected according to the present method are likewise very varied and depend both on the desired effects and on the nature of the materials used. The beads can be moved in translation, e.g. displacement, oscillation or vibration, or can be rotated. These motions may also be combined. They can be jerky or continuous. Depending on their nature, they will move the individual balls in translation and rotation in a relatively random manner depending on the kind of momentum imparted to the bed of balls and the density thereof, i.e. the mean free path of each ball. Preferably the bed of beads is given substantially gyratory motion in the horizontal or vertical plane. This motion results in centrifugal force, causing the beads to rebound against the walls of the metal containing the bed, resulting in collisions between the balls. Alternatively the balls can be thrown vertically upwards, whereupon they fall to the bottom of the vessel and rebound, producing comparable effects.

The device for working the method is defined in claim 10.

The device and method will be understood in greater detail by reference to the accompanying drawings, in which.

Figure 1:
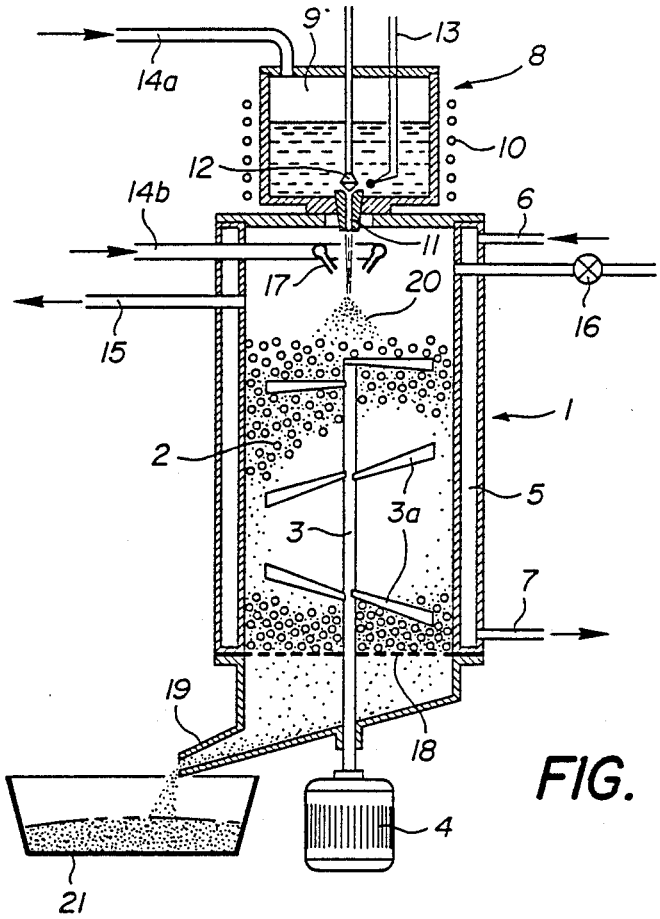
FIG. 1 is a diagram of a device for manufacturing metal powders from a molten metal.

FIG. 1 diagrammatically shows the device comprising a chamber 1 containing a bed of beads 2. The beads are made of a hard, inpact-resistant material such as steel and are driven by an axial agitator 3 having blades 3 and 3*a* actuated by a motor 4. Chamber 1 has double walls which include a sleeve 5 for conveying a cooling fluid coming from a pipe system for supplying liquid at 6 and discharging it at 7.

At the top, the device comprises a component 8 for keeping a molten metal liquid and distributing it in a desired manner inside the spray chamber 1. Component 8 comprises a reservoir 9 of molten metal provided with a heating means such as an inductive winding 10 and a flow nozzle 7 having a flow rate controlled by a needle-valve rod 12. The temperature of the molten metal can be measured by a thermocouple 13 and the metal is protected from oxidation by an inert gas such as Ar from a duct 14*a*.

Chamber 1 also comprises a gas inlet 14*a*, a gas outlet 15 and a protective device against excess pressure, represented in the drawings by a valve 16. The gas inlet 14*a* terminates in gas-injecting nozzles 17 disposed concentrically with the flow of molten metal from nozzle 11 and used for spraying (or atomising) the liquid metal in fine droplets. Chamber 1 also comprises a sorting component, i.e. a screen 18 having meshes calibrated so as to pass the metal powder formed in the chamber while retaining the beads. Chamber 1 also comprises a funnel 19 for connecting the metal powder coming from the device.

Operation thereof is briefly as follows: the metal to be broken up is placed in reservoir 9 and kept molten at a sufficient temperature for it to flow freely through nozzle 11 under the control of needle valve 12. The temperature of the metal, usually about 10° to 50° C. above the melting point, is kept constant by the heating element 10.

Agitator 3 is started up and, by means of blades 3*b*, drives the bed of beads 2 in rapid rotation. This motion, as the result of the centrifugal force acting on the bed of beads and (preferably) the presence of rough places on the inner surface of chamber 1, causes the beads to rotate and violently stirs the bed in the chamber. The balls are thrown in all directions and consequently collide.

Thereupon, the inflow of liquid metal into chamber 1 through nozzle 11 and the pressure of the spraying gas from nozzles 17 are adjusted so as to convert the molten metal into droplets 20 having the desired dimensions, and the droplets are thrown agaist the bed of moving balls 2.

As a result of the collision between the molten metal and the balls, the metal becomes further broken up in one or more stages, whereupon the metal fragments solidify into compact particles having sharp angles. The particles finally fall to the bottom of the chamber, where they travel to the sorting grid 18 and are collected through hopper 19 in a tank 21.

Figure 2:
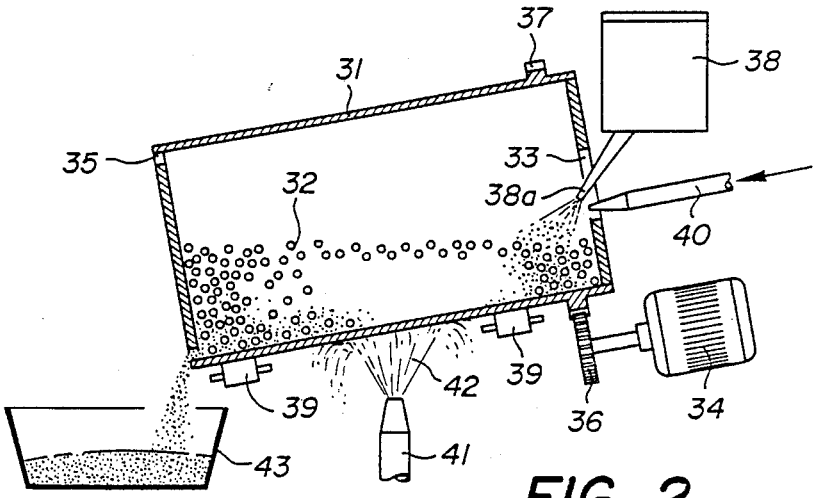
FIG. 2 shows another embodiment of the device.

FIG. 2 is a diagram of a device comprising a rotary drum 31 containing a bed of balls 32 and having a central circular opening 33 on one axial surface and an annular opening 35 on the other surface. Drum 31 is rotated by a motor 34 via a gear wheel 36 coaxial therewith and a toothed ring 37 secured to the outer surface of the drum. The rotating drum rests obliquely on rollers 39. The device in FIG. 2 also comprises a component 38 for distributing molten metal and represented in the drawing by a block. Component 38 is practically identical with the corresponding unit 8 in FIG. 1 and, for simplicity, has not been shown in detail in FIG. 2. The device also comprises a nozzle 40 for injecting gas (e.g. Ar or another inert gas). This gas is used if required to atomise the metal flowing from a nozzle 38*a* or component 38. Finally, the device also comprises cooling means 41 diagrammatically represented in the form of a jet of water 41 sprayed against the outer surface of the drum 31.

Briefly, the present variant of the device recorded for the invention operates as follows:

In a first mode of operation, the molten metal is atomised as in the device in FIG. 1, by a jet of gas from nozzle 39. The drops of molten metal obtained by atomisation are then sprayed onto the bed of beads 32 driven by the rotation of drum 31. The drops scatter among the beads and, as a result of the repeated collisions which they undergo while cooling, are converted into particles having sharp angles. The speed of rotation of the drum, the volume of the beads and the weight thereof are parameters which are adjusted to avoid excessive crushing of the particles, since this would result in excessively rounding them before they leave the drum through the annular opening 35 (which is too narrow to admit the beads) and are collected in tank 43.

In another mode of operation, the gas pressure in nozzle 39 is adjusted so that the jet of metal from nozzle 38*a* is only fragmented fairly roughly (into relatively large drops) instead of being atomised. On reaching the beads, the drops spread over their surface and form a thin film which solidifies into a solid film. As a result of the motion of the bed of beads, the solid film comes loose and is crushed and converted into flakes during its motion in the drum, which acts as a ball mill.

The shape and structure of the particles can therefore be varied via the parameters associated with the motion the beads in the drum (and the cooling rate thereof) and also via preliminary fragmentation (or non-fragmentation) of the jet of molten metal coming from nozzle 38*a*.

Figure 3:
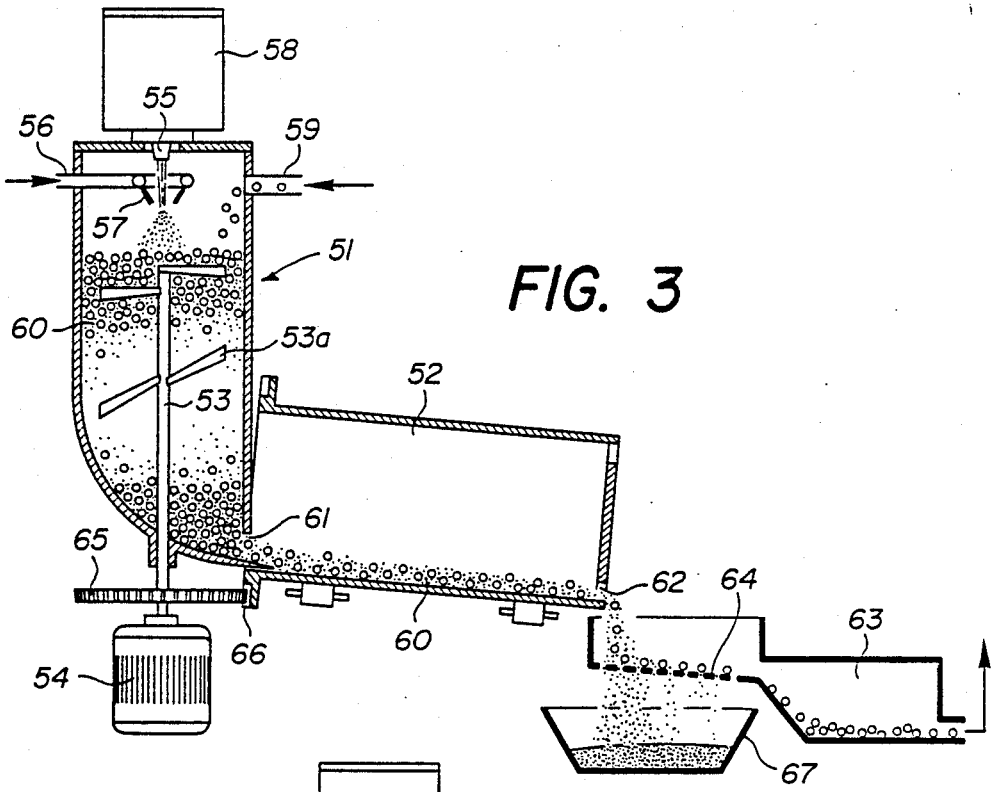
FIG. 3 shows another embodiment.

FIG. 3 diagrammatically shows a variant which to some extent combines the advantages of FIGS. 1 and 2. It comprises a vertical chamber 51 followed by an inclined rotary drum 52. Chamber 51 is swept by an agitator 53 having blades 53*a* driven by a motor 54, and at its top its receives a jet of atomised molten metal produced by a component 55 (identical in all respects with the corresponding component 8 in FIG. 1) provided with a nozzle 55, the jet being divided by a stream of gas coming from an inlet duct 56 and nozzles 57. Chamber 51 also comprises an inlet 59 for inserting beads to form a bed of beads 60. The beads gradually move from chamber 51 to drum 52 (via a first annular opening 61 therein) and come out through a second opening 62 in the opposite axial surface. The beads are then temporarily stored in a reservoir 63 after travelling through a sorting means 64 (a screen) and are then returned to chamber 51 through inlet 59.

Drum 52 is rotated by motor 54 via a gear wheel 65 and a toothed ring 66 at the edge.

The broken metal from nozzle 55 is initially pulverized in chamber 51 by the balls driven horizontally in rotation by agitator 53. It is then additionally crushed after leaving chamber 51 and entering drum 52 via aperture 61 in company with the moving beads. The crushing is due to the cascade motion applied to the beads in the rotating drum 52. Finally the mixture of beads and metal powder travels through screen 62 where the metal powder is separated and travels through the meshes and is collected in tank 57.

As in the previous variants, the device is adapted to operate in the presence of a protective gas (e.g. a noble gas). For simplicity, the drawing does not show the ducts for supplying and discharging this gas. Instead of having a protective effect, the gas admitted into the spray chamber can be a reactive gas, e.g. for oxidizing or nitriding or carburising the surface of the particles of the desired metal powder. The following are examples of such reactive gases: methane and other volatile hydrocarbons, carbon monoxide, cracked ammonia, etc.

Figure 4:
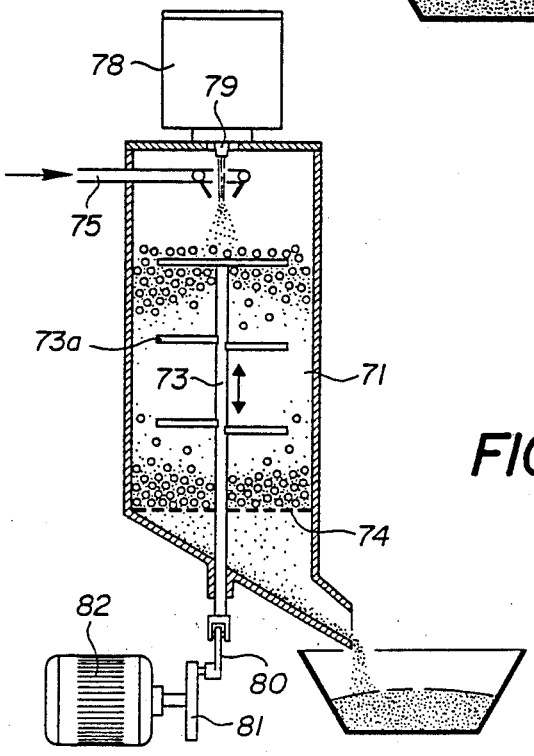
FIG. 4 shows another embodiment of the device, where the beads are driven vertically in reciprocation.

FIG. 4 shows a variant of the device which, like the preceding variants, comprises a spray and crushing chamber 71 containing a bed of balls 72 and a means 73 for agitating the balls. As before, the device also comprises a sorting means (screen) 74 at the bottom of chamber 71, a gas inlet 75 ending in nozzles 76 for spraying gas, and a means 78 adapted (like the corresponding components 8, 38 and 58 in the preceding variants) to supply a descending jet of molten metal through a nozzle 79, the jet being divisible by a gas under pressure from nozzle 76.

The bottom part of agitator 73 is pivoted to a rod 78, the base of which is pivoted to a crank 81 secured to a motor 82. In contrast to the preceding embodiments, therefore, agitator 73 is driven vertically in reciprocation. The balls are therefore thrown in one direction upwards at each oscillation of agitator blades 73*a*, and fall back through gravity. This motion (which has some degree of organisation) has a special effect on the shape and structure of metal particles formed by interaction between the balls and the droplets of sprayed molten metal. During cooling, the particles tend to acquire a somewhat elongate, almost fibrous shape. Objects manufactured by compacting or sintering these powders have different properties from those obtained from powders of identical composition but where the particles are compact (approximately parallelepipedal in shape) or in the form of flakes (micro-plates) obtained by crushing thin films. Note that in the embodiments in FIGS. 1–4, use could be made of a stream of molten metal which had not previously be pulverized. A specific example of forming a powder from a stream of non-pulverized metal will be described with reference to FIG. 5.

Figure 5:
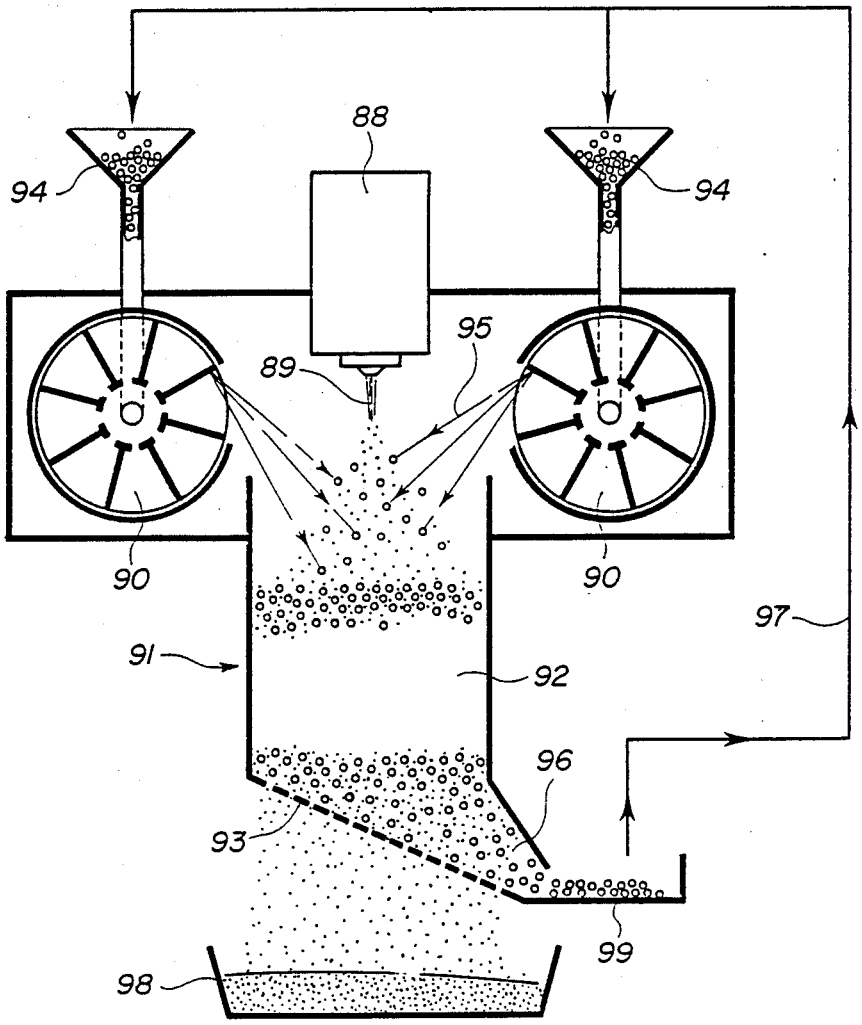
FIG. 5 shows another embodiment of the device, where the beads are conveyed from the top to the bottom of a vertical chamber, ejected at the bottom of the chamber and recycled from the top thereof.

The device shown in FIG. 5, as in the previous embodiments, comprises a fragmentation chamber 91 containing a bed of beads 92. The chamber can have a double heating wall as in FIG. 1, although not shown in the drawing.

Like the preceding embodiments (see FIG. 1), the device also comprises a component 88 for distributing molten metal in the form of a continuous jet of liquid metal 89. The jet is not pulverized into micro-droplets as in the preceding embodiments but simply flows through the bed of moving beads and is fragmented by colliding with the balls.

The device also comprises two turbines 90 for accelerating the beads, which are supplied by hoppers 94. The hoppers extend towards the axial zone of the turbines and the balls entering therein are ejected (as shown at 95) by the centrifugal force resulting from the rotation of the turbine rotors. The turbine speed can be varied so as to vary the speed at which the beads come out, their direction and the force of impact between them and the molten metal.

At the bottom of the chamber, the device also comprises a perforated end wall 93 for screening the metal powder formed by the liquid metal striking the beads and abruptly cooling after being fragmented as a result. The device also comprises a bead outlet duct, a collecting tank 99 and a duct 97 for recycling the beads back to hoppers 94. The beads are converyed in the recycling line 97 by conventional drive means (not shown in the drawing). The metal powder formed as a result accumulates in a tank 98 and can be taken therefrom as needed. At the bottom of the chamber, before the powder is separated from the balls, the device can also comprise a mill for crushing the particles to be desired size after they had been fragmented and solidified by the present process. The crushing operation may also be performed subsequently and independently.

As can be seen, the various embodiments of the invention result in metal powders having particles which, in addition to properties depending on the choice of metal or alloy, have a shape and geometry which have to be adjusted in dependence on the configuration of the fragmenting device, the nature and size of the beads in the bed, the manner and speed of agitation thereof, the temperature of the molten metal, the type and pressure of the atomising gas and the efficiency of cooling the liquid metal, i.e. the rate at which the particles harden when interacting with the bed of moving beads.

In general it has been found that the following parameters give advantageous results at the following values:

In the case of a particular distribution of molten metal, the size of the metal droplets (with or without atomisation) at the outlet of the distribution nozzle was 20μ-1 mm. Continuous distribution of metal: flow rate 50–100 g/min.

Average speed of beads in the agitated bed: 1–1000 m/sec.

Apparatus density of the bed of balls relative to the apparent density of the atomised material: 3/1-10/1.

Relation between the volume of molten metal metal sprayed per unit time and the speed of the beads multiplied by their cross-section: $10^{-5}$ to $10^{-1}$.

The following Example illustrates the invention:

EXAMPLE 1

A spray device similar to that shown in FIG. 1 was used. The spray chamber had an approximate diameter of 200 mm and was 250 mm high and contained 5 kg of steel balls 3 mm in diameter. The rotating agitator drove the balls in translation at an average speed of 5 m/sec at an angular speed of 500 rpm. A molten Fe-C-Si-B alloy was distributed over the balls at a temperature of 1200° C. and a flow rate of 120 g/min. Argopn at a pressure of 4–6 bars and a flow rate of 12 l/min was used for atomisation. The approximate average size of the resulting liquid metal droplets was 30–200μ. The powdered alloy was collected at the bottom of the column through screen (18) and was made up of compact particles having sharp corners and an approximate size of 20–50 μm. The particles were compacted and sintered by conventional methods to obtain mechanical components having particularly high strength.

EXAMPLE 2

A spray device similar to that shown in FIG. 5 was used and comprised a cyclindrical chamber 0.5 m in diameter and 1 m long. The oblique screening zone had meshes of about 0.5 mm.

The chamber was equipped with turbines 0.25 m in diameter rotating at speeds of the order of 2000 to 5000 rpm. 0.2 cm steel balls were conveyed at a flow rate of 0.25 to 1 kg per sec. The nozzle for distributing molten metal supplied a jet 0.5 mm in diameter.

Molten aluminium heated to 860° C. was pulverized at a flow rate of 2.8 g/sec, giving a powder made up of flakes having sharp edges and a size between about 50 and 400 μm. The process was also applied to molten tin at 630° C. pulverised at a flow rate of 5 g/sec, using 1 kg/sec of steel balls, the results being approximately similar.

The aforementioned aluminium powder was formed into a paste by crushing 1 part thereof by weight with 0.9 parts of isobutyl methyl ketone and 0.1 parts of methanol.

A coating base was then formed from a 3:4:3 mixture (by weight) of trimethylol propane triacrylate, diethylene glycol diacrylate and EBECRYL-600 (an acrylic prepolymer made by Union Chimique Belge) and methyl amyl ketone, in the proportion of 4 parts of monomer resins to 1 part of solvent.

Next, 1 part of aluminium paste was mixed with 6 parts of the base and 0.1 parts of polymerisation catalyst.

A plate of sheet metal was coated with a layer of the mixture about 300 μm thick, then left to stand in air for 1 hour and then heated for 2 hours in an oven at 60°–80° C. The result was a metalised coating having a decorative appearance.

We claim:

1. A method of manufacturing metal powders by breaking up a liquid metal into droplets and then placing them in contact with a cooling component capable of bring about a quenching effect so as to give them a specific structure typical of rapid cooling, wherein the cooling and solidifying component comprises a bed of beads of solid impact-resistant material subjected to rapid colliding and rebounding motion by agitation.

2. A method according to claim 1, wherein the metal is first divided into droplets which are brought into contact with the moving beads, whereupon the droplets are crushed against the bead surfaces and solidify thereon, forming a metal film which is then broken into fine compact particles by the beads which collide with one another.

3. A method according to claim 1, wherein the molten metal is directed towards the moving beads with a kinetic energy sufficient to divide the metal into droplets which then solidify, the bed of beads serving both a means for fragmentation and also for cooling.

4. A method according to claim 3, wherein the resulting fragments are particles having sharp corners.

5. A method according to claim 1, wherein the beads are rounded, ovoid or spherical.

6. A method according to claim 5, wherein the beads are shock-resistant metal or ceramic balls.

7. A method according to claim 1, wherein the beads are driven in translation at a speed of 1 to 100 m/sec.

8. A method according to claim 1, wherein the beads rotate at a speed of $10^2$–$10^4$ rpm.

9. A method according to claim 1, wherein after solidification, the resulting metal powder is separated from the bed of beads.

* * * * *